US005207362A

United States Patent [19]

Janus et al.

[11] Patent Number: 5,207,362

[45] Date of Patent: * May 4, 1993

[54] JOGGERS AID

[75] Inventors: Ronald E. Janus, Deerfield Beach, Fla.; Dean A. Monco, Chicago, Ill.

[73] Assignee: Ji-Sco-Ni Enterprises, Inc., Chicago, Ill.

[ * ] Notice: The portion of the term of this patent subsequent to May 4, 2010 has been disclaimed.

[21] Appl. No.: 487,426

[22] Filed: Mar. 2, 1990

Related U.S. Application Data

[63] Continuation of Ser. No. 850,970, Nov. 26, 1986, abandoned, which is a continuation-in-part of Ser. No. 927,159, Nov. 5, 1986, abandoned, which is a continuation of Ser. No. 798,406, Nov. 15, 1985, abandoned.

[51] Int. Cl.[5] ..... A45F 5/00

[52] U.S. Cl. ..... 224/148; 224/202; 215/1 A

[58] Field of Search ..... 224/148, 202, 205, 207; 220/425, 3.1, DIG. 13; 2/197, 183; 215/1 A, 100 A; 383/907; 206/806; 229/7.5

[56] References Cited

U.S. PATENT DOCUMENTS

| | | | |
|---|---|---|---|
| 33,313 | 9/1861 | Garrick . | |
| D. 160,314 | 10/1950 | Fuller | 206/553 X |
| 298,985 | 5/1884 | Kimball . | |
| 1,637,635 | 11/1926 | Corley . | |
| 2,013,475 | 9/1935 | Orton | 215/1 A |
| 2,057,933 | 10/1936 | Brinkman | 224/148 |
| 2,945,614 | 7/1960 | Wittmann, Sr. | 224/148 |
| 3,065,944 | 11/1962 | Liebendorfer | 224/148 X |
| 3,106,312 | 10/1963 | Hitchcock | 215/1 A |
| 3,197,099 | 7/1965 | Doba | 224/201 X |
| 3,730,336 | 5/1973 | Feldman | 229/7.5 X |
| 3,814,288 | 6/1974 | Westrich | 224/202 X |
| 3,830,270 | 8/1974 | Hagert et al. | 383/907 |
| 4,090,650 | 5/1978 | Gotta . | |
| 4,139,130 | 2/1979 | Glusker et al. . | |
| 4,140,254 | 2/1979 | Land | 224/148 |
| 4,165,814 | 8/1979 | Seel | 220/212 X |
| 4,176,772 | 12/1979 | Dannon . | |
| 4,196,817 | 4/1980 | Moser | 215/1 A X |
| 4,420,097 | 12/1983 | Motsenbocker . | |
| 4,462,503 | 7/1984 | Di Raffaele et al. | 215/1 A X |
| 4,526,298 | 7/1984 | Boxer et al. . | |
| 4,544,087 | 10/1985 | Modig | 224/148 |

FOREIGN PATENT DOCUMENTS

| | | | |
|---|---|---|---|
| 508 | of 1869 | United Kingdom | 224/148 |
| 14646 | of 1885 | United Kingdom | 224/148 |

*Primary Examiner*—Linda J. Sholl
*Attorney, Agent, or Firm*—James C. Paschall

[57] ABSTRACT

This invention pertains to a container for liquid which has strap members capable of securing the container to a user's neck. A straw is inserted into the container for the removal of liquid. When not in use, the straw will be secured by a retaining member. Adhesive is placed along the back side of the container to be secured to the user's clothing so as to reduce movement of the container during activity such as running or bicycling.

34 Claims, 3 Drawing Sheets

FIG. 1
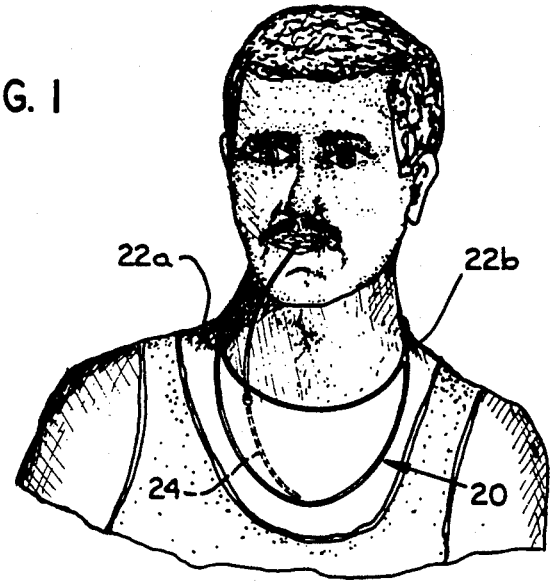
FIG. 3
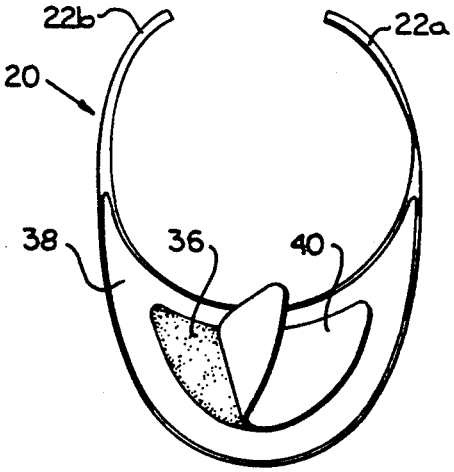
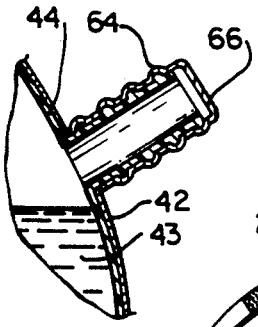
FIG. 13
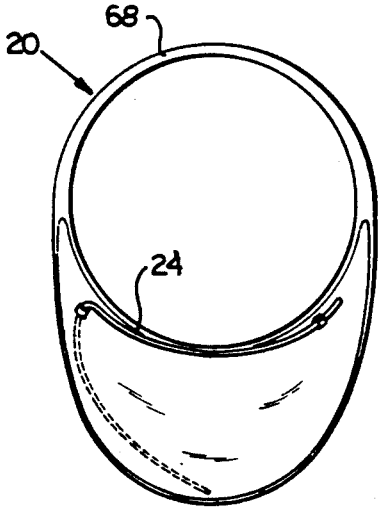
FIG. 14
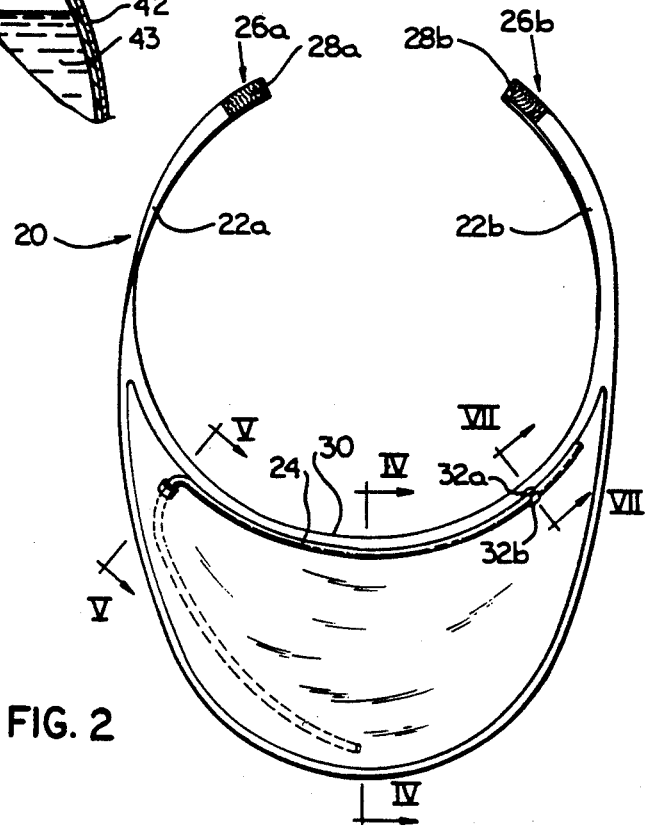
FIG. 2
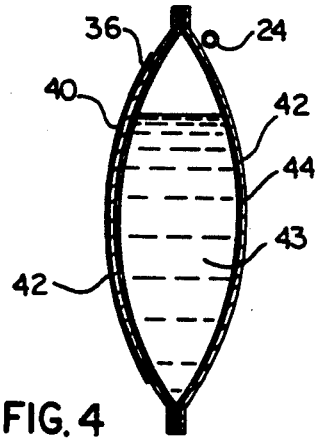
FIG. 4

FIG. 15
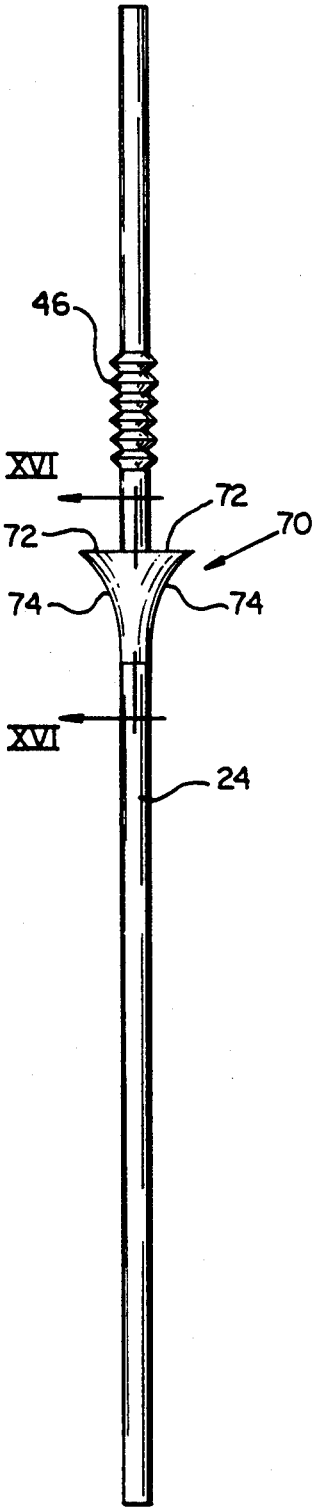
FIG. 16
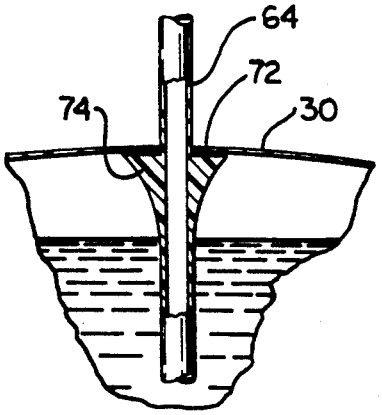
FIG. 17
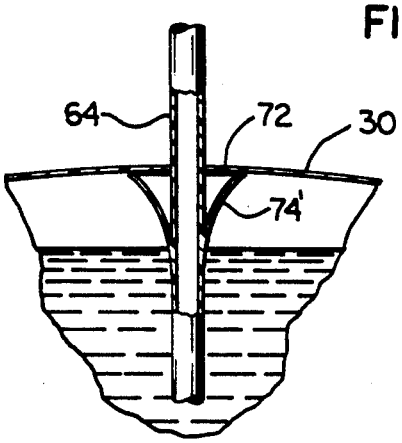
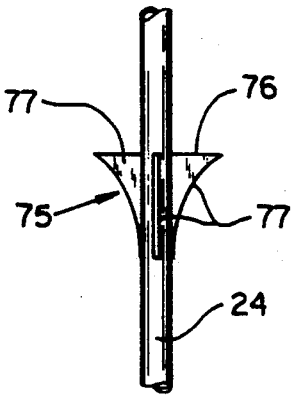
FIG. 18

JOGGERS AID

BACKGROUND OF THE INVENTION

This is a continuation of co-pending application Ser. No. 850,970 filed on Nov. 26, 1986, entitled "Joggers' Aid" now abandoned, which is a continuation-in-part application of co-pending application Ser. No. 927,159 filed Nov. 5, 1986 entitled "Joggers' Aid" now abandoned, which is a continuation of application Ser. No. 798,406 filed Nov. 15, 1985 entitled "Joggers' Aid", now abandoned.

This invention relates to a device which would provide a user with access to a fluid during strenuous activity such as bicycling or jogging while enabling his hands to be free.

One of the major problems with exercising is the inability to conveniently carry a supply of liquid to replenish the fluids which are excreted by the body during exercise. Under certain conditions, a person exercising may lose an excessive amount of fluids resulting in faintness, heat stroke, or on rare occasions, death. Because of the inconvenience of carrying a container of fluid in one's hand while exercising, people simply refrain from carrying containers with them while engaging in exercise.

Previous devices have consisted of apparatuses which fit either over a person's shoulders to be carried on the back, or around the waist. These devices are quite cumbersome and extremely impractical when used during exercise. The fluid stored in such a container is located too far away from a user's mouth, requiring a great deal of suction to move the liquid to the user's mouth. Since the user is already expending considerable energy during exercise, such devices are considered hindrances rather than aids.

SUMMARY OF THE INVENTION

The present invention relates to a container for fluid which is capable of being secured around a user's neck so as to provide the user with a ready supply of easily accessible fluid during exercise. More specifically, the device comprises a generally arcuate shaped container having individual straps at each end of the container which are capable of being secured around the user's neck. The container will be relatively thin and flat so as to be capable of holding a sufficient amount of liquid without causing discomfort to the user while exercising.

The container may either be rigid or flexible, while the interior of the container is preferably insulated so as to minimize the thermal exchange effects between the user's body and the container. The strap members may be secured to one another through a variety of means. One means would be a projecting member extending from one strap and capable of being inserted into a corresponding aperture member on the opposite strap. An alternative means for securing the straps would be a series of projections extending from the ends of each strap which would be capable of being inserted into the spaces formed between projecting members in an interlocking fashion when the straps are pressed together.

Still a third means of securing the strap members together would be by placing adhesive material at the ends of each strap, such as VELCRO®, which may be pressed together to form a secure means to hold a container. All three securing means identified above may be readily and repeatedly locked and unlocked by the user.

An adhesive strip generally in the shape of the container is provided on the back side of the container which, when pressed against the clothing of the user, will reduce the movement of the container during exercise. The adhesive will be covered by a strip of contact paper which may be readily removed by the user prior to exercise.

A tubular device or member, such as a straw, will extend from the bottom center portion of the container up through the wall of the container to the user's mouth. When not in use, the user may fold the straw across the ridge of the container and secure it thereto with insertion of the straw between two inwardly-biased, upright projection members.

The straw member itself may have one or more flexible joints or portions, such as accordion elbow portions in that section of the straw extending from the container. The purpose of these accordion elbows is to provide the user with flexibility during physical activity and to facilitate the folding of the straw when not in use into the slot formed by the extension members.

A further purpose for the accordion elbow portions is to minimize injury to the user during a fall. On impact, the straw would collapse on itself along the accordion elbow portions so as to minimize the chance of the straw beigg forced down the user's mouth and throat.

An optional feature on the straw member would be a series of detent members, such as inverted, relatively rigid conical or triangular shaped projections extending uniformly around the surface of the straw slightly below the first accordion elbow portion and within the interior of the container. The purpose of these detent members is to generally prevent the removal of the straw after insertion into the container. This is an additional safety feature for the user, should a fall occur.

As an alternative embodiment, the container may have a hollow threaded extension portion formed on the wall of the container so as to provide communication with the interior of the container. A threaded cap member would be capable of being screwed onto the threaded extension member to form an air-tight, liquid tight seal. It is intended that the container be capable of holding carbonated beverages and to retain said carbonation for an extended period of time. When desired, the user would simply screw off the cap and insert a straw through the extension portion into the container to remove the liquid.

It is an objective of this invention to provide a user with a convenient means for storing and drinking liquid during physical activity.

BRIEF DESCRIPTION OF THE DRAWINGS

FIG. 1 is a perspective view of the container in use.

FIG. 2 is a front plan view of the container.

FIG. 3 is a rear plan view of the container.

FIG. 4 is a cross-sectional view of the container along lines IV—IV of FIG. 2.

FIG. 13 is an enlarged view of a threaded extension member formed on the container.

FIG. 14 is a front plan view of an alternate embodiment of the invention.

FIG. 15 is a perspective view of the straw member having conical detent means used with the container.

FIG. 16 is a cross-sectional view of the straw member along lines XVI—XVI of FIG. 15.

FIG. 17 is a cross-sectional view of an alternative embodiment of the straw member.

FIG. 18 is a perspective view of another alternate embodiment of the straw member having triangular shaped detent means.

DESCRIPTION OF THE PREFERRED EMBODIMENT

Figure 9:
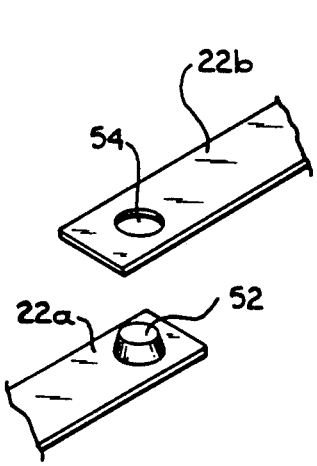
FIG. 9 is an enlarged view of the securing means for the strap members.

In the drawings, FIG. 1 illustrates a container 20 as it is intended to be used. The container 20, ordinarily made of plastic, such as polyethylene, polypropylene, or acrylic resins is a generally arcuate or C-shaped configuration with generally flat walls, an enlarged or flared mid-portion and a pair of strap members 22*a*, 22*b* extending from the ends of said arcuate shaped container 20 and secured to one another around a user's neck. The breadth of the container 20 will be substantially greater in proportion to the relatively narrow width. Although the walls of the container 20 are generally flat, they may have slightly concave portions to conform to the shape of the user's chest. The container 20 will be formed by means of a blow molding process well known in the plastics industry.

The container 20 will be capable of holding either carbonated or non-carbonated beverages. A tubular member such as a straw 24 extends generally from the lowest mid-point of the container 20 through the wall of the container up to the user's mouth. Liquid may be extracted from the container by the user by sucking on the end of the straw 24.

FIG. 2 is a more detailed perspective of the container 20. End portions 26*a*, 26*b* of strap members 22*a*, 22*b* have a self-adhesive substance 28*a*, 28*b* such as VELCRO® placed in such a manner so that when pressed together by the user, the end members 26*a*, 26*b* will adhere to one another with sufficient strength to support the container 20. The adhesive substance 28*a*, 28*b* will be of sufficient strength to support the container but will render the end members capable of being repeatedly pulled apart and pressed together without a great deal of effort by the user. The length of the strap members 22*a*, 22*b* will be such that the container 20 will be positioned below the user's neck and lay across the user's upper chest.

As shown in FIG. 2, the straw 24 is not being used. When not in use, it is intended that the straw member will lay along the upper ridge 30 of the container 20 and will be secured thereto by insertion between a pair of inwardly-biased projection members, 32*a*, 32*b*. The straw 24 may be inserted and removed from the projection members 32*a*, 32*b* repeatedly without detrimental effect to the integrity of the straw 24. The projection members 32*a*, 32*b* are formed generally along the upper ridge 30 of the container 20.

In order to prevent excessive movement of the container 20 during exercise, FIG. 3 shows a second adhesive substance 36 placed on a back side 38 of the container 20. This second adhesive 36 may also be VELCRO®. Prior to use, the second adhesive substance 36 is covered by a strip of tear-away contact paper 40. As shown in FIG. 3, when required for use, the user will tear off the paper 40 and press the second adhesive substance against his or her clothing on the user's chest. In this manner, the container 20 will be secured primarily by strap members 22*a*, 22*b*, and secondarily, by the second adhesive substance 36 pressing against the user's clothing. The primary purpose of this second adhesive substance 36 is to prevent excessive movement of the container 20 during exercise.

As shown in FIG. 4, an insulating material 42 such as aluminum may be placed around center portion 43 of container 20 for the purpose of maintaining the liquid contained therein at a specified temperature, and to minimize any thermal exchange which might occur between the liquid contained in the container 20 and the user's body. Additionally, the interior walls of the container may be lined with insulation material to reduce thermal exchange between the user's body and the container. As an alternative insulation, a hollow space can be formed between the outer wall of the container 20 and the center portion 43.

Figure 5:
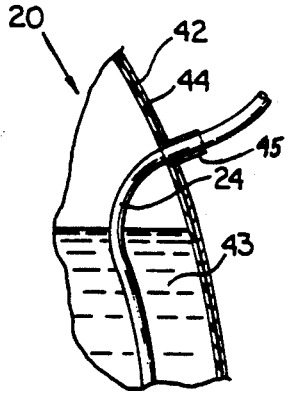
FIG. 5 is a cross-sectional view of the container along lines V—V of FIG. 2.
Figure 6:
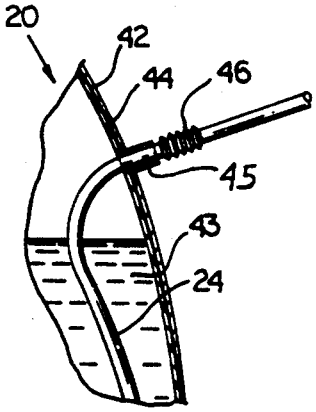
FIG. 6 is an enlarged sectional view of an alternative embodiment of the straw member of the container shown in FIG. 5.

FIG. 5 shows the straw 24 extending through a hollow neck portion 45 formed on a front wall 44 of the container 20. The neck portion 45 may also be formed on the upper ridge 30. Liquid is poured into the container 20 through the neck portion 45 prior to insertion of the straw 24. FIG. 6 shows a collapsible joint such as as accordion elbow 46 which is formed on straw member 24 to provide the user with maximum flexibility in maneuvering the straw to his/her mouth during physical activity. Additionally, the accordion elbow 46 provides a degree of safety to the user in that it would diminish serious injury during a fall while the user is drinking. On impact, the straw 24 would collapse along accordion elbow 46 so as to minimize the risk that the straw 24 would be driven through the user's mouth and down his or her throat in the event of a fall or sudden impact. One or more accordion elbows 46 may be formed on the straw 24 for safety purposes.

Figure 7:
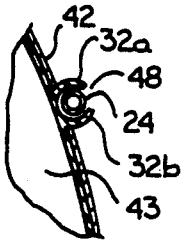
FIG. 7 is a cross-sectional view of the container along lines VII—VII of FIG. 2.

In FIG. 7, the straw 24 is inserted in a securing means such as between the two inwardly-biased bracket members 32*a*, 32*b*. In this illustration, the bracket members 32*a*, 32*b* are generally C-shaped. The straw 24 may be lifted out of a slot 48 formed between the bracket members 32*a*, 32*b* repeatedly without any detrimental effect to the integrity of the straw 24. The inward bias of the bracket members 32*a*, 32*b* will be sufficient merely to secure the straw without causing any damage to the straw 24 by repeated removal and replacement. It is contemplated that the bracket members 32*a*, 32*b* will be formed directly on the front wall 44 of the container 20 in a one-piece construction.

Figure 8:
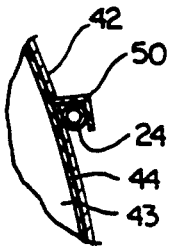
FIG. 8 is an alternative embodiment of the securing means shown in FIG. 7.

An alternative embodiment to the bracket members 32*a*, 32*b* is shown in FIG. 8. A generally L-shaped member 50 is formed on the front wall 44 in a one-piece construction. The straw 24 may be inserted and secured between one side of the L-shaped member 50 and the front wall 44. As in the previous embodiment shown in FIG. 7, it is contemplated that the L-shaped member 50 will be sufficiently inwardly-biased to secure straw 24 while permitting easy removal and insertion without damage to the straw 24.

Figure 10:
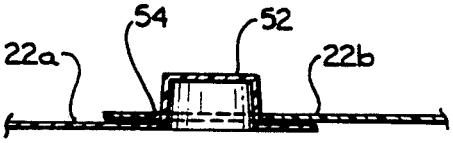
FIG. 10 is a side view of the securing means shown in FIG. 9.

FIGS. 9 and 10 show another means to secure the strap members together so as to support the container in use. An outwardly-directed projection member 52 is formed on strap 22*a* while a corresponding aperture is formed on strap 22*b*. When use is desired, the user will insert a projection member 52 into the aperture 54 so as to secure straps 22*a* and 22*b* together, enabling the container 20 to be supported around the user's neck. When the user wishes to remove the container from around his/her neck, the user will merely push the projection member 52 through the aperture 54, disconnecting the strap members 22*a* and 22*b*.

Figure 11:
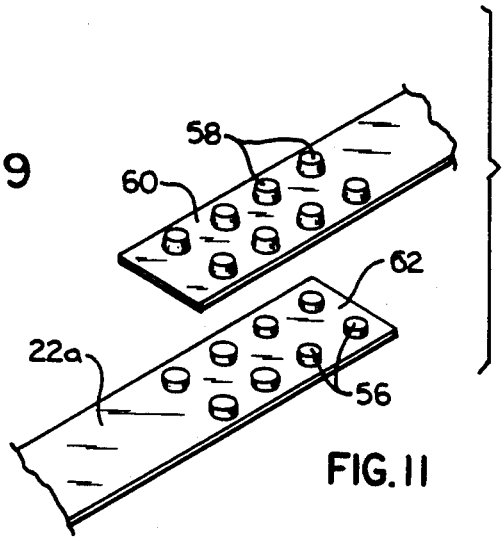
FIG. 11 is an enlarged view of alternative securing means for the strap members.
Figure 12:
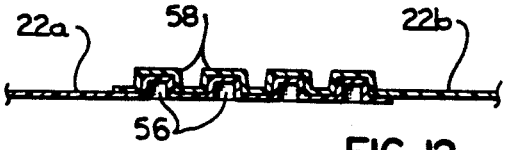
FIG. 12 is a side view of the alternate securing means shown in FIG. 11.

A third means to secure the strap members is illustrated in FIGS. 11 and 12. FIG. 11 shows a series of closely spaced, upwardly-directed projection members 56 formed on strap 22*a* and a corresponding number of closely spaced, downwardly-directed projection members 58 on strap 22*b*. When the user desires to secure the straps together, he/she will compress the straps 22*a* and 22*b* together so that the series of upwardly-directed, spaced projection members will be inserted into spaces 60 formed by the series of downwardly-directed, spaced projection members 58 on strap 22*b*. Correspondingly, the series of downwardly-directed, spaced projection members 58 will be inserted into spaces 62 formed by the upwardly-directed, spaced projection members 56. In this manner, a grid will be formed capable of securing the container to the user's neck. When use is no longer required, the user will merely lift strap 22*b* from strap 22*a* and the connection will be broken.

One alternative to the neck portion 45 is shown in FIG. 13. A hollow threaded extension member 64 is formed on the upper ridge 30 of the container 20. A threaded cap 66 is formed such that it may be screwed onto the threaded extension member 64 so as to form an air-tight, liquid-tight seal. When use is desired, the cap 66 may be unscrewed and the straw 24 may be inserted through the extension member 24 into the container 20.

The container 20 will be capable of holding either carbonated or non-carbonated beverages. Additionally, the container 20 which is intended to be made from a plastic material such as polyethylene or polypropylene, will be capable of being filled with a carbonated beverage and, by means of the threaded cap 66, will be capable of maintaining the carbonation in a beverage for an extended period of time. This would enable the carbonated liquid to be maintained on a shelf in a retail outlet, as well as being stored in a user's home, without loss of carbonation. The materials comprising the container 20 will be biologically compatible with the carbonated and non-carbonated liquid contained therein, and will meet all governmental requirements for beverage containers.

FIG. 14 represents a second alternative embodiment to the present invention in which the container is secured around the user's neck by means of a ring 68 formed from the same material as the container 20. That is, container 20 and ring 68 are a one-piece device. The container is simply slipped over the user's head and may be removed in the same fashion.

An added safety feature for the user would be detent members such as a series of uniform, inverted conical or triangular shaped retention members formed on the surface of the straw 24 which will generally prevent the straw from being removed from the eontainer 20.

Such a safety modification is shown in FIGS. 15 and 16. A one piece inverted, conically shaped retention member 70 is positioned generally axially on the surface of straw 24. The retention members 70 are formed together with the straw 24 as a one piece unit by means of a molding process well known in the plastics industry. The conical retention member 70 is generally rigid, although it retains a certain amount of flexibility to enable the straw 24 to be inserted into and beyond the threaded extension member 64. The triangular retention member 70 comprises a ledge 72 and a solid relatively thin, generally rigid supporting portion 74.

The size of the retention member 70 will be compatible with the size of the opening on the extension member 45 or threaded extension member 64. During insertion into the container 20 through the extension member 45 or the threaded extension member 64, the conical retention member 70 will fold inwardly toward the straw 24. Once past the threaded extension member 64 and into the interior of the container 20, the conical retention member 70 will resume its shape, with the ledge 72 abutting the lower, interior portion of the extension member 45 or the threaded extension member 64. The user will generally not e able to remove the straw 24 once it is inserted into the container 20.

FIG. 17 illustrates an alternative embodiment of retention member 70 in which the supporting portion 74' is hollow.

FIG. 18 illustrates a second alternative embodiment of a detent member in which a series of generally independent triagular shaped fins 75 are positioned axially around the straw 24. The fins 75 comprise a ledge 76 and a support member 77. The fins 75 function in the same manner as that described for the conically shaped retention member 70 illustrated in FIGS. 15–17 above.

Variations and modifications of the present invention may be made and remain within the spirit of applicant's invention as defined herein.

I claim:

1. A container for holding a carbonated or non-carbonated beverage around a user's neck so as to be disposed on or adjacent the user's upper torso, comprising:

means defining an integral, generally flat, thin, hollow, arcuate-shaped container having a pair of front and rear walls which are substantially symmetrical to one another on either side of an imaginary plane extending through the center line of said front and rear walls, said front and rear walls joined peripherally at the edges and comprised substantially of polymeric material which are substantially liquid and gas impermeable, with said rear wall generally contoured in a substantially flat shape for disposition adjacent the user's front;

aperture means formed on an upper arcuate-shaped portion and intermediate the end portions of said arcuate shaped container for delivering liquid through the intermediately disposed aperture means upwardly during use into the user's mouth; and strap means for continuously securing and supporting the container around the user's neck during use.

2. The container according to claim 1 wherein said means for securing and supporting the container around the user's neck comprises a pair of strap members extending from the ends of the container and having means to secure the strap members to one another.

3. The container according to claim 2 wherein said means for securing the strap members to one another comprises placing an adhesive substance on the ends of each strap member so that the ends of the strap members may be pressed together to secure the container around the user's neck.

4. The container according to claim 2 in which said strap members are secured to one another by means of a vertical projection member extending outwardly from one strap member and capable of being inserted into a corresponding aperture formed on the second strap.

5. The container according to claim 2 in which said means for securing the strap members to one another comprises a series of spaced projections formed in each strap member and capable of being pushed together in such a manner that the projections of one strap may be inserted into the spaces formed between the projection members of the other strap.

6. The container according to claim 1 having means to prevent excessive movement of the container during exercise.

7. The container according to claim 1 wherein the walls of said generally flat, hollow arcuate shaped container may be slightly concave to conform to the shape of the user's chest.

8. A container for receiving and holding a pressurized or non-pressurized liquid around a user's neck comprising:

means defining an integral, generally flat, thin, hollow, arcuate-shaped container having a pair of front and rear walls which are substantially symmetrical to one another on either side of an imaginary plane extending through the center line of said front and rear walls, said front and rear walls joined peripherally at the edges and comprised substantially of polymeric material which are substantially liquid and gas impermeable, with said rear wall generally contoured in a substantially flat shape for disposition adjacent the user's front;

aperture means formed on an upper arcuate-shaped portion and intermediate the end portions of said arcuate-shaped container for delivering liquid through the intermediately disposed aperture means upwardly during use into the user's mouth;

relatively narrow strap means extending from the end portions of said container for continuously securing and supporting said container around a user's neck during use; and a tubular member extending upwardly from said container so as to enable the user to remove the liquid contents therein by means of suction, whereby the user is able to suction liquid upwardly from the container without interruption while engaging in physical exercise.

9. The container according to claim 8 in which said arcuate-shaped hollow container has a flared mid-portion such that the entire container my be filled with liquid.

10. The container according to claim 8 in which said tubular member comprises a straw having at least one accordion elbow formed on that portion of said straw extending above said container so as to enable said straw to be folded.

11. The container according to claim 8 in which a securing means is formed on said container so as to receive the straw and hold it in a folded position until required for use.

12. The container according to claim 11 in which said securing means comprises a pair of inwardly biased, C-shaped bracket members.

13. The container according to claim 11 in which an alternative securing means comprises an L-shaped member formed on the front wall of said container and capable of securing the straw between itself and the container.

14. The container according to claim 8 in which the walls of said hollow container are insulated with insulation material to reduce thermal exchange between the user's body and the container.

15. The container according to claim 8 in which a hollow space is formed between the exterior wall of said container and the hollow center portion of the container, so as to provide insulation for the liquid contents.

16. The container according to claim 8 in which the breadth of said container is substantially greater in proportion to the width.

17. The container according to claim 8 in which a hollow neck portion extends from a wall of the container so as to provide means for pouring liquid into the container.

18. The tubular member according to claim 8 in which detent means comprising an inverted conically shaped retention member is formed on the surface of the tubular member so as to prevent the removal of the tubular member after insertion into the container.

19. The tubular member according to claim 18 in which said conically shaped retention member comprises a ledge and a support member.

20. The tubular member according to claim 8 in which detent means comprising a series of generally triangular shaped fins are formed axially on said tubular member.

21. The tubular member according to claim 20 in which said fins comprise a ledge and support member.

22. The container according to claims 1 or 8 in which the strap means extends over a relatively small portion of a user's torso so as to minimize retention of heat against the user's body.

23. A container for receiving carbonated or non-carbonated liquid and holding the liquid around a user's neck, comprising;

means defining an integral, generally flat, thin, hollow, arcuate-shaped container having a pair of front and rear walls which are substantially symmetrical to one another on either side of an imaginary plane extending through the center line of said front and rear walls, said front and rear walls joined peripherally at the edges and comprised substantially of polymeric material which are substantially liquid and gas impermeable, with said rear wall generally contoured in a substantially flat shape for disposition adjacent the user's front;

a hollow threaded extension member formed on an upper arcuate-shaped portion and substantially intermediate the end portions of said arcuate-shaped container for delivering liquid upwardly during use into the user's mouth; and relatively narrow strap means extending from the end portions of the container and suspended around the user's neck and extending over a relatively small portion of the user's torso for continuously securing and supporting the container around a user's neck during use.

24. The container according to claim 23 in which the container is capable of maintaining the carbonation in the carbonated beverage for an extended period of time.

25. The container according to claim 23 in which a tubular means extends upwardly from said container through said threaded extension member so as to enable the user to remove the liquid contents therein by means of suction.

26. The container according to claim 23 in which an air-tight, liquid-tight seal may be formed over said threaded extension member by means of a threaded cap.

27. A container for holding carbonated or non-carbonated liquid around a user's neck comprising:

a one-piece, generally flat, thin, hollow, arcuate-shaped container having a pair of front and rear walls which are substantially symmetrical to one another on either side of an imaginary plane extending through the center line of said front and rear walls, said front and rear walls joined peripherally at the edges and comprised substantially of polymeric material which are substantially liquid and gas impermeable, with said rear wall generally contoured in a substantially flat shape for disposition adjacent the user's front;

aperture means formed on an upper arcuate-shaped portion and intermediate the end portions of said arcuate-shaped container for delivering liquid through the intermediately disposed apertrue means upwardly during use into the user's mouth; and a ring member formed on said one-piece container capable of being placed over a user's head so as to provide continuous support of the container around a user's neck during use.

28. The container according to claim 27 in which a tubular member extends upwardly from said one piece container so as to enable the user to remove the liquid contents therein by means of suction.

29. A container for receiving and holding a liquid around a user's neck comprising:

means defining an integral, generally flat, thin hollow, arcuate-shaped container having a pair of front and rear walls which are substantially symmetrical to one another on either side of an imaginary plane extending through the center line of said front and rear walls, said front and rear walls joined peripherally at the edges and comprised substantially of polymeric material which are substantially liquid and gas impermeable, with said rear wall generally contoured in a substantially flat shape for disposition adjacent the user's front;

aperture means formed intermediate the end portions of said arcute-shaped container for delivering liquid through the intermediately disposed aperture means upwardly during use into the user's mouth; and relatively narrow strap means extending downwardly from the user's neck and over a relatively small portion of a user's torso for continuously securing and supporting said container around a user's neck during use.

30. A container for holding a liquid around a user's neck comprising:

means defining an integral, generally flat, thin, hollow, arcuate-shaped container having a pair of front and rear walls which are substantially symmetrical to one another on either side of an imaginary plane extending through the center line of said front and rear walls, said front and rear walls joined peripherally at the edges and comprised substantially of polymeric material which are substantially liquid and gas impermeable, with said rear wall generally contoured in a substantially flat shape for disposition against the user's chest;

first means for continuously securing and supporting said container around a user's neck during use;

means for providing user access to the liquid in the container during use; and second means for securing the container to the user to prevent excessive movement.

31. The container according to claims 1, 23, 27, 29 or 30 in which the polymeric material is polyethylene.

32. The container according to claims 1, 23, 27, 29 or 30 in which the polymeric material is polypropylene.

33. The container according to claims 1, 23, 27, 29 or 30 in which he polymeric material is acrylic resin.

34. A container for holding a carbonated or non-carbonated liquid around a user's neck comprising:

means defining an integral, generally flat, hollow arcuate-shaped container having walls comprised substantially of polymeric material which are substantially liquid and gas impermeable;

strap means for securing and supporting the container around a user's neck; and means to prevent excessive movement of the container during exercise comprising an adhesive dispose don the side of the container facing the user's body.

* * * * *